US007134368B2

(12) United States Patent
Nagy

(10) Patent No.: US 7,134,368 B2
(45) Date of Patent: Nov. 14, 2006

(54) INTERCHANGEABLE SCREWDRIVER FOR TOOL BITS

(75) Inventor: Gyula Kalder Nagy, Winnipeg (CA)

(73) Assignee: The Innovak Group Inc., Point-Claire (CA)

( * ) Notice: Subject to any disclaimer, the term of this patent is extended or adjusted under 35 U.S.C. 154(b) by 125 days.

(21) Appl. No.: 10/776,468

(22) Filed: Feb. 12, 2004

(65) Prior Publication Data

US 2005/0076750 A1 Apr. 14, 2005

Related U.S. Application Data

(63) Continuation-in-part of application No. 10/348,338, filed on Jan. 22, 2003, now abandoned.

(51) Int. Cl.
*B25G 1/08* (2006.01)
*B25B 23/00* (2006.01)

(52) U.S. Cl. ..... 81/490; 81/439; 81/177.4

(58) Field of Classification Search ..... 81/490, 81/177.4, 439
See application file for complete search history.

(56) References Cited

U.S. PATENT DOCUMENTS 4,572,038 A * 2/1986 Graham ..... 81/439
4,893,529 A * 1/1990 Lin ..... 81/177.4
4,976,175 A * 12/1990 Hung ..... 81/439
4,989,480 A * 2/1991 Chen ..... 81/439
6,134,995 A 10/2000 Shiao
6,138,537 A * 10/2000 Cole ..... 81/439
6,196,093 B1 * 3/2001 Hu ..... 81/490
6,502,484 B1 1/2003 Pao-Hsi
6,601,483 B1 8/2003 Wannop

* cited by examiner

*Primary Examiner*—Hadi Shakeri
(74) *Attorney, Agent, or Firm*—Adrian D. Battison; Michael R. Williams; Ryan W. Dupuis

(57) ABSTRACT

A screw driver for housing and supplying bits has a housing with a elongate tube extending through the housing along the axis to a forward presentation end of the tube at which the bits are presented for use. The housing has a rotatable storage holder mounted in the housing for holding and storing a plurality of tool bits and arranged by manual engagement with an exposed side portion to rotate about a second axis parallel to the tube. A plunger carried on an end cap with a hexagonal sleeve has a flat magnetic bit carrying face at the forward end and receives a cooperating portion of the housing as a sliding fit. The holder is removable by pressing an ejection button on an opposite face of the housing and has a magnet which holds the bits in place. The plunger is restricted against free sliding movement by a friction head which presses against the side of the plunger.

15 Claims, 4 Drawing Sheets

INTERCHANGEABLE SCREWDRIVER FOR TOOL BITS

This application is a continuation-in-part of application Ser. No. 10/348,338 filed Jan. 22$^{nd}$ 2003 now abandoned.

The present invention relates to a screwdriver which has a plurality of bits that are interchangeable within the driver.

BACKGROUND OF THE INVENTION

A tool such as a screwdriver or the like, generally, comprises a handle that has a portion which extends forwardly for rotation a single type of screw. Some screwdrivers are adapted to allow an operator to change the bit for use with different types of screws so that only one screwdriver is needed in place of many different types. These changeable screwdrivers, generally, require the operator to manually remove the bit from the screwdriver and replace it with an new one, which causes a chance that the bit may be lost or misplaced. Many times the bits are held in the handle which can be opened to allow access.

The screwdriver of the present invention can be used for screw driving bits, sockets, drill bits or other bits which have a different operation and need to be changed within the driver for different jobs.

Examples of screw drivers of this general type are shown in U.S. Pat. Nos. 6,134,995 (Shaio) issued Oct. 24$^{th}$, 2000, U.S. Pat. No. 6,502,484 (Pao-Hsi) issued Jan. 7$^{th}$, 2003 and U.S. Pat. No. 6,601,483 (Wannop) issued in 2003.

SUMMARY OF THE INVENTION

It is one object of the present invention to provide an improved screwdriver.

According to a first aspect of the present invention there is provided a screwdriver comprising:

a housing having a first axis therealong and an outer manual grasping surface which generally coaxially surrounds the axis and which provides a surface which can be grasped by a user for rotating the housing about the axis;

an elongate tube attached to the housing for rotation therewith having a hollow interior and extending through the housing along the first axis to a forward presentation end of the tube;

the housing having a generally cylindrical receptacle defining a second axis adjacent to and parallel to the first axis;

a rotatable storage holder mounted in the housing containing a plurality of tool bits and arranged to rotate about the second axis;

the rotatable holder including a plurality of receptacles each containing a respective one of the tool bits, the receptacles being arranged parallel to the second axis and in angularly spaced relation around the second axis;

the rotatable holder and the first and second axes being arranged such that rotation of the holder causes each receptacle in turn to move from an operating position aligned with the first axis to a storage position spaced from the first axis;

an end cap slidable longitudinally relative to the housing for movement from a retracted position to a forward position;

a plunger carried on the end cap and mounted within the tube for forward and rearward movement therein from the retracted position, in which a forward end of the plunger is retracted rearwardly of the holder, to the forward position adjacent the forward presentation end;

the plunger having a magnetic bit carrying head at the forward end for carrying a bit from that receptacle of the holder which is in the operating position from the receptacle forwardly along the tube to the presentation end;

the holder being rotatable in the housing when the plunger is moved to the retracted position to move the receptacles to carry the bits from the operating position to the storage positions;

the elongate tube having an interior surface which is polygonal in cross section and matches an outer surface of each of bits such that rotation of the housing causes rotation of the elongate tube and driving rotation of the bit;

the holder being mounted in the housing so that it is readily removable from and replaceable in the housing by movement in a direction away from the first axis and an ejection member mounted on the housing and manually operable for applying an ejection force to the holder for rejecting the holder from the housing for replacement.

Preferably the ejection member comprises a button manually depressible on the housing at a position thereon opposite to the holder.

Preferably the head of the plunger includes a flat front face for contacting a flat rear face of the bit such that rotation of the holder sweeps the bit off the flat face of the head.

Preferably the end cap carries a sleeve which surrounds the plunger and surrounds a portion of the housing with the portion of the housing extending into the sleeve such that the plunger is enclosed in the extended and retracted positions.

Preferably the sleeve is polygonal and cooperates with a polygonal portion of the housing to transfer torque therebetween.

Preferably the end of the sleeve buts against a shoulder on the housing.

Preferably the holder includes a magnet mounted in the holder so as to apply a magnetic force tending to hold the bits in place in the receptacles when the holder is removed from the housing.

Preferably the magnet is mounted in an axial central bore of the holder.

Preferably there is provided an indexing arrangement providing detents at specific angularly spaced locations of the rotation of the holder so that each detent corresponds to the angular location of a respective one of the receptacles so as to align that receptacle on the first axis.

Preferably the holder includes a first and a second portion which are axially separated and butt at an radial plane of the portion and wherein the indexing arrangement comprises a spring loading the first and second portions toward one another and at least one projections on one of the portions which engages into corresponding indents on the other one of the portions such that the projection requires an increased spacing of the portions against the bias of the spring to rotate the portions between the indents.

According to a second aspect of the present invention there is provided a screwdriver comprising:

a housing having a first axis therealong and an outer manual grasping surface which generally coaxially surrounds the axis and which provides a surface which can be grasped by a user for rotating the housing about the axis;

an elongate tube attached to the housing for rotation therewith having a hollow interior and extending through the housing along the first axis to a forward presentation end of the tube;

the housing having a generally cylindrical receptacle defining a second axis adjacent to and parallel to the first axis;

a rotatable storage holder mounted in the housing containing a plurality of tool bits and arranged to rotate about the second axis;

the rotatable holder including a plurality of receptacles each containing a respective one of the tool bits, the receptacles being arranged parallel to the second axis and in angularly spaced relation around the second axis;

the rotatable holder and the first and second axes being arranged such that rotation of the holder causes each receptacle in turn to move from an operating position aligned with the first axis to a storage position spaced from the first axis;

an end cap slidable longitudinally relative to the housing for movement from a retracted position to a forward position;

a plunger carried on the end cap and mounted within the tube for forward and rearward movement therein from the retracted position, in which a forward end of the plunger is retracted rearwardly of the holder, to the forward position adjacent the forward presentation end;

the plunger having a magnetic bit carrying head at the forward end for carrying a bit from that receptacle of the holder which is in the operating position from the receptacle forwardly along the tube to the presentation end;

the holder being rotatable in the housing when the plunger is moved to the retracted position to move the receptacles to carry the bits from the operating position to the storage positions;

the elongate tube having an interior surface which is polygonal in cross section and matches an outer surface of each of bits such that rotation of the housing causes rotation of the elongate tube and driving rotation of the bit;

the holder being mounted in the housing so that it is readily removable from and replaceable in the housing by movement in a direction away from the first axis;

wherein the end cap carries a sleeve which surrounds the plunger and surrounds a portion of the housing with the portion of the housing extending into the sleeve such that the plunger is enclosed in the extended and retracted positions.

According to a third aspect of the present invention there is provided a screwdriver comprising:

a housing having a first axis therealong and an outer manual grasping surface which generally coaxially surrounds the axis and which provides a surface which can be grasped by a user for rotating the housing about the axis;

an elongate tube attached to the housing for rotation therewith having a hollow interior and extending through the housing along the first axis to a forward presentation end of the tube;

the housing having a generally cylindrical receptacle defining a second axis adjacent to and parallel to the first axis;

a rotatable storage holder mounted in the housing containing a plurality of tool bits and arranged to rotate about the second axis;

the rotatable holder including a plurality of receptacles each containing a respective one of the tool bits, the receptacles being arranged parallel to the second axis and in angularly spaced relation around the second axis;

the rotatable holder and the first and second axes being arranged such that rotation of the holder causes each receptacle in turn to move from an operating position aligned with the first axis to a storage position spaced from the first axis;

an end cap slidable longitudinally relative to the housing for movement from a retracted position to a forward position;

a plunger carried on the end cap and mounted within the tube for forward and rearward movement therein from the retracted position, in which a forward end of the plunger is retracted rearwardly of the holder, to the forward position adjacent the forward presentation end;

the plunger having a magnetic bit carrying head at the forward end for carrying a bit from that receptacle of the holder which is in the operating position from the receptacle forwardly along the tube to the presentation end;

the holder being rotatable in the housing when the plunger is moved to the retracted position to move the receptacles to carry the bits from the operating position to the storage positions;

the elongate tube having an interior surface which is polygonal in cross section and matches an outer surface of each of bits such that rotation of the housing causes rotation of the elongate tube and driving rotation of the bit;

the holder being mounted in the housing so that it is readily removable from and replaceable in the housing by movement in a direction away from the first axis;

wherein the holder includes a magnet mounted in the holder so as to apply a magnetic force tending to hold the bits in place in the receptacles when the holder is removed from the housing.

According to a fourth aspect of the present invention there is provided a screwdriver comprising:

a housing having a first axis therealong and an outer manual grasping surface which generally coaxially surrounds the axis and which provides a surface which can be grasped by a user for rotating the housing about the axis;

an elongate tube attached to the housing for rotation therewith having a hollow interior and extending through the housing along the first axis to a forward presentation end of the tube;

the housing having a generally cylindrical receptacle defining a second axis adjacent to and parallel to the first axis;

a rotatable storage holder mounted in the housing containing a plurality of tool bits and arranged to rotate about the second axis;

the rotatable holder including a plurality of receptacles each containing a respective one of the tool bits, the receptacles being arranged parallel to the second axis and in angularly spaced relation around the second axis;

the rotatable holder and the first and second axes being arranged such that rotation of the holder causes each receptacle in turn to move from an operating position aligned with the first axis to a storage position spaced from the first axis;

an end cap slidable longitudinally relative to the housing for movement from a retracted position to a forward position;

a plunger carried on the end cap and mounted within the tube for forward and rearward movement therein from the retracted position, in which a forward end of the plunger is retracted rearwardly of the holder, to the forward position adjacent the forward presentation end;

the plunger having a magnetic bit carrying head at the forward end for carrying a bit from that receptacle of the holder which is in the operating position from the receptacle forwardly along the tube to the presentation end;

the holder being rotatable in the housing when the plunger is moved to the retracted position to move the receptacles to carry the bits from the operating position to the storage positions;

the elongate tube having an interior surface which is polygonal in cross section and matches an outer surface of each of bits such that rotation of the housing causes rotation of the elongate tube and driving rotation of the bit;

the holder being mounted in the housing so that it is readily removable from and replaceable in the housing by movement in a direction away from the first axis;

wherein the holder includes a first portion defining the receptacles and a second portion rotatable relative to the first portion about the second axis;

the second portion having an abutment thereon for engaging the housing and preventing rotation of the second portion relative to the housing;

and an indexing arrangement providing detents at specific angularly spaced locations of the rotation of the holder so that each detent corresponds to the angular location of a respective one of the receptacles so as to align that receptacle on the first axis.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
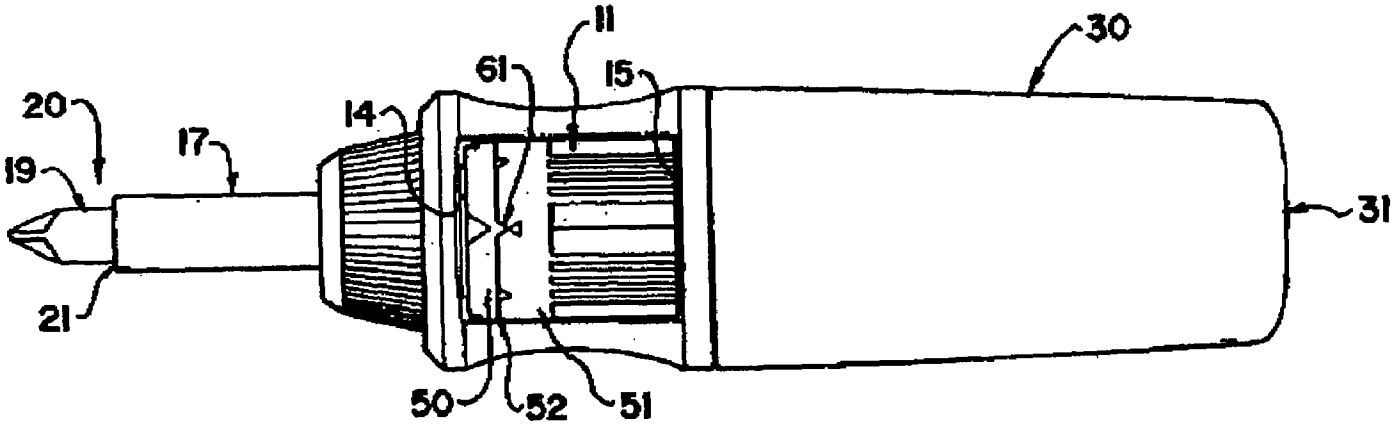
FIG. 1 is a top plan view of a screwdriver according to the present invention with the end cap and sleeve in the forward position presenting a bit at the forward end of the screw driver.

The screwdriver shown herein comprises a main housing 10 which receives and supports a holder 11. The holder 11 defines a plurality of receptacles 12 arranged parallel to a longitudinal axis 13 of the cylindrical holder 11. The holder has two end faces 14 and 15 at right angles to the axis 13 allowing the holder to slide into a receptacle 16 in the housing 10.

At the front of the housing 10 is provided a tube 17 which is attached to the housing and is rotatable therewith. The tube 17 has a hexagonal inside surface 18 along which a bit 19 from the holder can slide to a forward presentation position 20 at a forward end 21 of the tube 17 the hexagonal inside surface 18 matches an exterior surface of the bit so as to drive rotation of the bit with the tube as the housing is rotated and carries with it the tube 17 which is attached to the housing. The tube 17 is located so as to surround the axis 22 of the housing. The housing has a main body portion 23 which locates the holder 11 and provides a generally cylindrical portion but with a concave outer surface as indicated at 24. A forward connecting portion 25 of the housing extends from the main cylindrical portion 24 forwardly and inwardly toward the tube 17 so as to form a conical shape transitioning between the front of the housing and the tube itself. The arrangement is shaped and arranged to provide an attractive appearance and to provide easy hand grasping with suitable shaping and knurling or other frictional elements on the outside as required.

Figure 2:
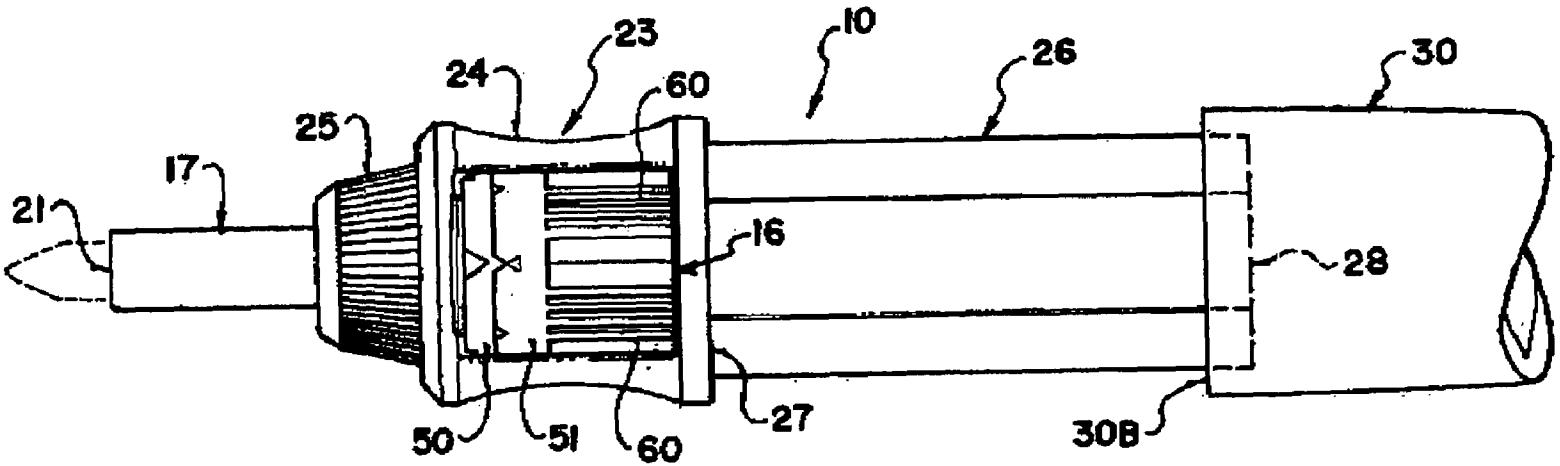
FIG. 2 is a top plan view similar to that of FIG. 1 showing the end cap and sleeve in the retracted position.
Figure 3:
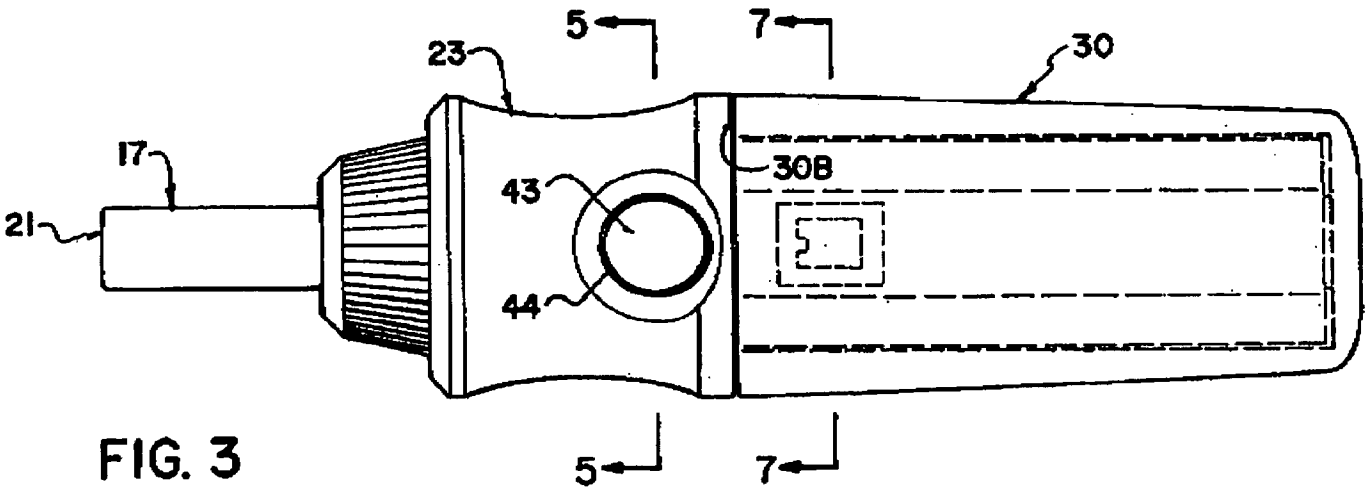
FIG. 3 is a bottom plan view of the screwdriver of FIG. 1.

The housing further includes a further generally cylindrical portion 26 which extends from a rear end face 27 of the main housing portion 23 rearwardly along the housing to a remote end 28. An end cap and sleeve 30 is mounted on the end 28 of the housing portion 26 so that it is fixed in place and cannot slide beyond the end of the end 28 by the suitable interconnection between the inside of the sleeve and the outside of the end 28. The sleeve 30 with its end cap 31 can thus slide forwardly and rearwardly between the positions shown in FIGS. 1 and 2 from a forward operating position to a rearward retracted position.

The end cap 31 carries a plunger 33 which extends from the end cap 31 through a guide in the housing portion 26, through the receptacle 16 and into the tube 17. The plunger 33 extends to a forward end 34 at which is attached a magnetic holder 35 for receiving the bit 19. The bit 19 has a flat rear face 19A which abuts against a flat front face 36 of the magnetic holder so that the rear face 19A is held against the magnetic holder at the forward end of the tube 17. The bit can however be removed forwardly through the open end of the tube 17. However it is restrained from doing so by its magnetic coupling with the magnetic holder 35. Thus the bit which is aligned on the axis 22 of the housing at which is located the plunger is carried from the holder into the tube for presentation at the forward end of the tube for driving rotation of the bit by manual rotation of the screw driver.

The holder 11 can be rotated about is axis 13 within the receptacle 16. Thus with the plunger retracted by movement of the end cap 31 to the retracted position shown in FIG. 2, the plunger is removed from the rear of the holder and all of the buts are located within the holder. Thus the user can rotate manually the holder so as to align a selected one of the bits with the axis 22 thus allowing the plunger to be moved forwardly with the end cap to carry from the holder the selected bit to the presentation position.

Figure 7:
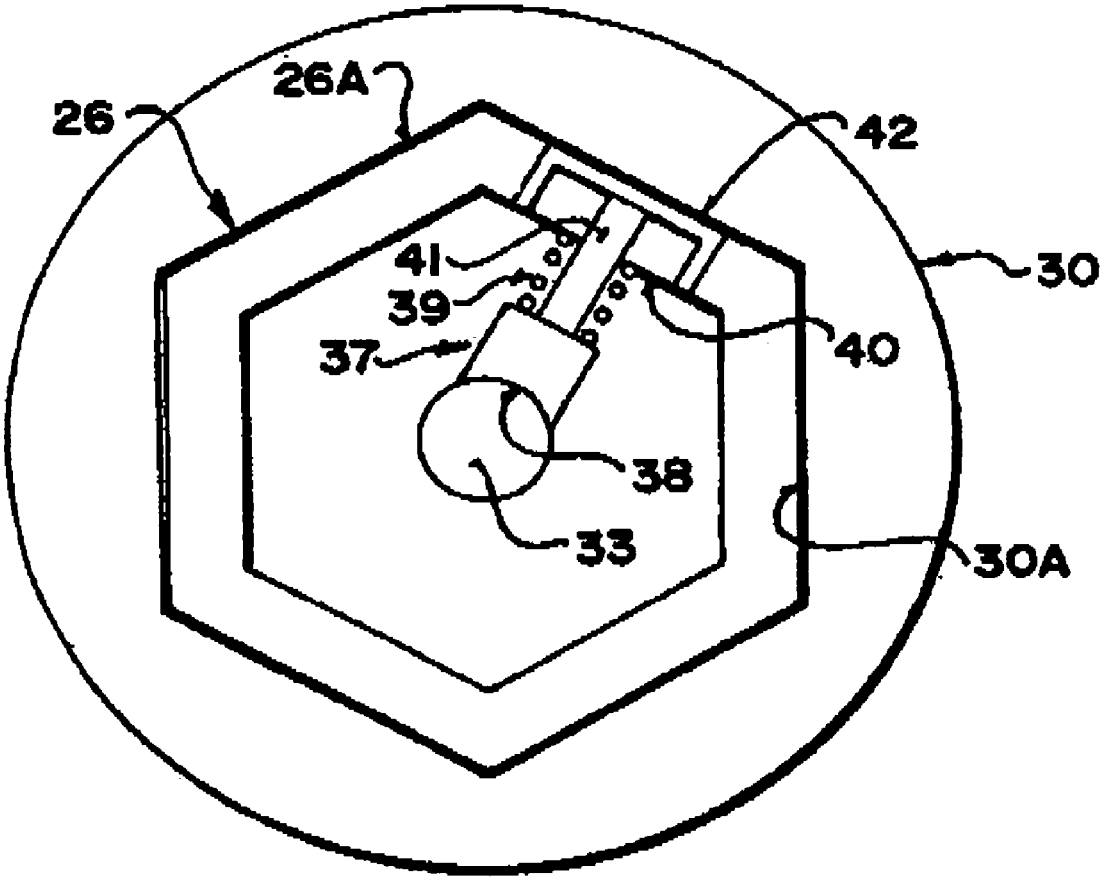
FIG. 7 is a cross sectional view along the lines 7—7 of FIG. 3.

As shown in FIG. 7, the elongate portion 26 of the housing has a polygonal outside surface 26A which cooperates with and matches a polygonal inside surface 30A of the sleeve 30. In practice the surface may be hexagonal but other polygonal shapes may be selected so as to provide the ability for torque to communicated by manual grasping of the sleeve 30, by rotation of the sleeve 30 by which the elongate portion 26 is also rotated to drive rotation of the housing 10, the tube 17 and the bit.

The sleeve 30 is free to slide forwardly and rearwardly on the elongate portion 26 so that the plunger 33 can slide forwardly and rearwardly between the forward and retracted positions. In order to frictionally hold the end cap and the plunger at any particular selected position, there is provided a frictional engagement member 37 with a curved front face 38 which buts against a side of the cylindrical surface of the plunger 33. The front face 38 is biased into engagement with the plunger by way of a spring 39 which presses against an inside surface 40 on the elongate portion 26. The friction head 37 is carried on a shaft 41 so that it can slide into engagement with the plunger by way of the pressure from the spring 39 and the structure is covered by an end cap 42 on the outside surface of the portion 26. Thus the end cap is free to slide without restriction from the forward position to the retracted position and there is no locking at either location but it is frictionally restrained by the friction head 37 so that it does not tend to slide open when intended to be in the forward operating position and it does not slide forward when intended to be in the retracted position which would interfere with the proper manual rotation of the holder. In the forward position of the sleeve 30, an end face 30B of the sleeve buts against the end face 27 of the main portion 23 of the housing which defines a shoulder surrounding the elongate portion 26.

On the main portion 23 of the housing is provided an eject button 43 for ejecting the holder 11 from its position within the recess 16. The button 43 is mounted in a concave recess 44 on the side of the main housing portion 23 opposite to the holder. The button includes a shaft 45 which extends through a bore 46 in the housing portion 23. A spring 47 biases the button to the extended position in which the end of the pin 46 is spaced away from the holder allowing the holder to remain within the chamber or receptacle 16 for free rotation as required. The pin 46 carries a stop member 48 which prevents the pin from being removed from the bore 46 on the action of the spring 47 and holds it in place in a retracted position. However when the user wishes to expel or eject the holder, simple manual pressure on the exposed portion of the button 43 act to push the holder away from the receptacle 16 sufficiently for it to be grasped by the fingers of the user and pulled away for removal and replacement.

It will be appreciated that a series of holders can be provided with different bits so that a selected one of the holders can be used carrying required bits and inserted into the chamber 16 as required. The user has therefore available a relatively large number of bits which are carried in individual holders.

The holder 11 is formed in two separate sections 50 and 51. These sections but at a connection line 52 lying in a radial plane of the axis 13. A spring 53 pulls the two pieces 50 and 51 together so they are butting and provide a single piece as the holder.

Figure 6:
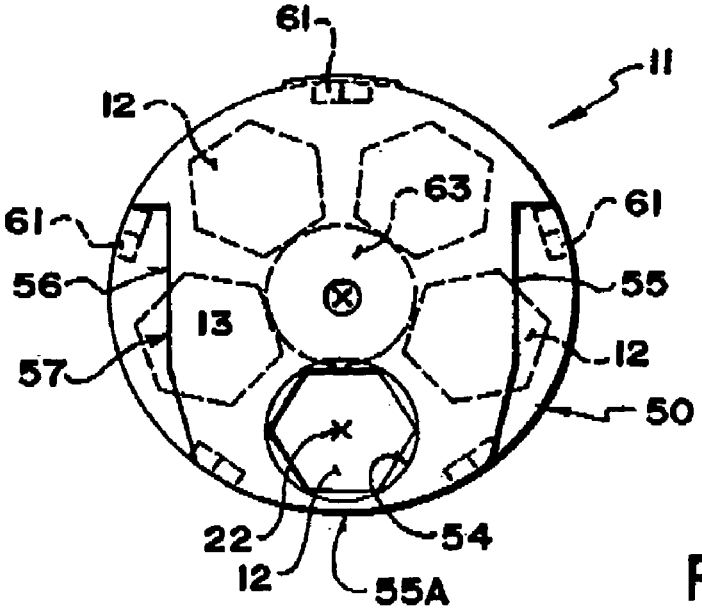
FIG. 6 is an end elevational view of the holder of the screwdriver of FIG. 1.

An end view of the piece 50 is shown in FIG. 6. The piece 50 is thus generally closed except for a hole 54 which is located on the axis 22 when the holder is inserted into the receptacle 16. The hole 22 also aligns with the cylindrical recesses 12 each of which receives a bit. Thus when a respective of the receptacles 12 is moved to the hole 54, the selected bit is located at the hole 54 and can be pushed by the plunger along the axis 22 into the tube 17.

Figure 5:
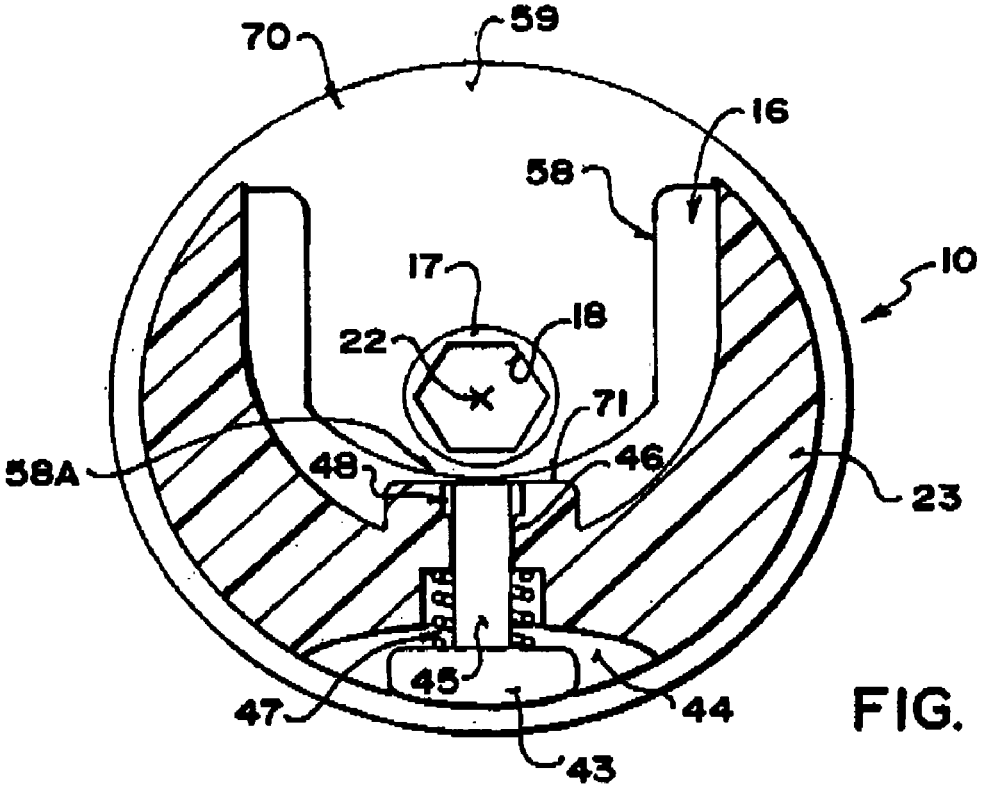
FIG. 5 is a cross sectional view along the lines 5—5 of FIG. 3 with the bit holder removed.

The piece 50 includes two shoulders 55 and 56 defining an insert piece 57 which cooperate with a U-shaped receptacle 58 in the end wall 59 of the receptacle 16. thus when the portion 50 is dropped into the receptacle 16 as best shown in FIG. 5 the shoulders 55 and 56 prevent the portion 50 from being rotated within the housing so that portion must remain stationary.

The receptacles 12 are located in the portion 51 which can rotate relative to the portion 50 when manually turned by the user grasping recesses 60 along the length of the portion 51 which provide a frictional surface. The portion 50 includes a series of projecting members 61 at angularly spaced positions around the periphery of the end face 52. The number of projections is equal to the number of recess 12 and they are the same angularly spaced positions so that each projection forms a detent which can engage into a corresponding recess in the portion 51 to locate the rotation of the portion 51 at the angular locations where a selected one of the receptacles 12 is aligned with the hole 54 thus in practice the person manually rotating the portion 51 by engaging the recesses 60 feels slight clicks as the projections engage into the recesses and provide an indexing system. The projections of course require the portions 50 and 51 to be forced apart against a spring to allow the projection to rotate when it is not sitting in one of the recesses. In this way the rotation of the recesses within the holder is indexed to move each of the recesses in turn to the required position for alignment with the axis 22 and the plunger 33.

The bits are loosely received within the recesses 12 so they can slide along the recess 12 freely when engaged by the plunger also the bits can be moved from the end 15 of the holder through open ends of the recesses breaking out on the open end of the portion 51 at the end face 15. A magnet 63 is located in the end of the portion 51 at the end face 15 so as to provide a magnetic force tending to prevent the bits from being expelled or falling freely from the end of the portion 51 of the holder 11. Thus the bits tend to remain in place within the holder when the holder is removed.

Figure 4:
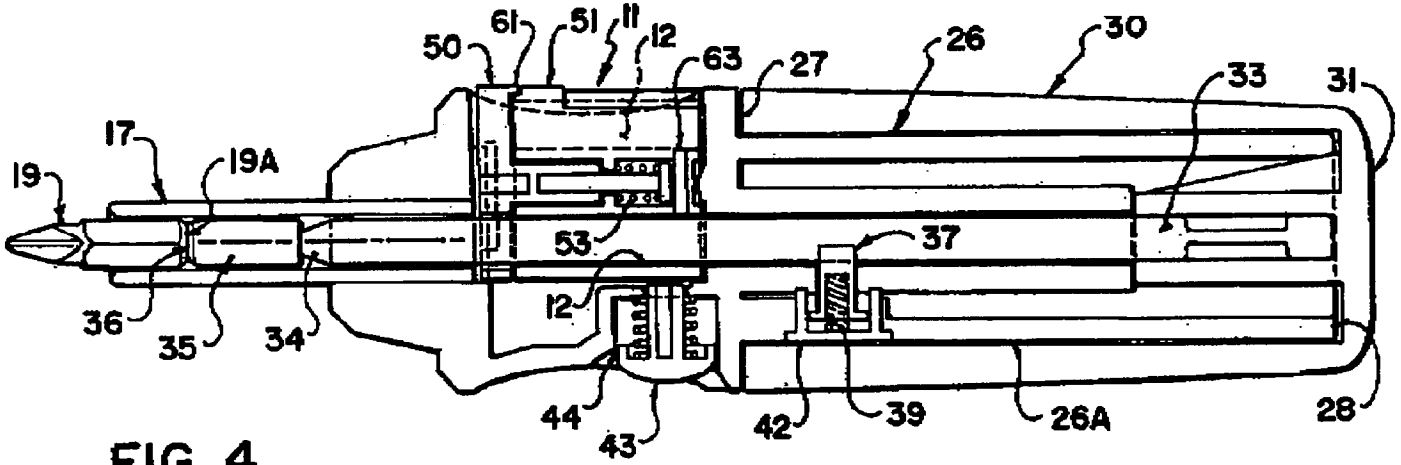
FIG. 4 is a longitudinal cross sectional view of the screwdriver of FIG. 1.

As show in FIGS. 4, 5 and 6, the holder is not held in place within the receptacle 16 by any axle nor by any projecting element which extend from the ends of the holder at the end faces 14 and 15. The holder is thus engaged as a friction fit within the receptacle 16 by engagement of the end faces of the holder with the end faces of the receptacle and by engagement of the sides of the holder with the sides of the receptacle. The receptacle is of course generally of U-shape with an open face 70 having a width equal to the diameter of the holder. The holder can thus be inserted until substantially the whole of the holder is received within the circle defining the periphery of the holder. At the end 14 of the receptacle, the shoulders 55 and 56 sit on the surface 58 so that a bottom edge 55A rests upon a bottom edge 58A of the receptacle 58. Thus at that end the holder is pressed into place until the shoulder sits on the surface. At the opposite end, as shown in FIGS. 5 and 6, a projecting face 71 is provided which receives the outside surface of the portion 51 of the holder and is aligned with the end face of the pin 45. Thus when the pin 45 is depressed by pressing the button 43 the pin emerges from its end face 71 and presses against the outside surface of the holder ejecting it from the receptacle. In the meantime during operation, the cylindrical outside surface of the holder is confined within the holder by the sides of the receptacle, by the ends of the receptacle, by the surface 58A and by the end face 71 of the projection at the base of the receptacle.

The arrangement as shown has the advantages that the holder is readily insertable and removable for replacement due to the friction fit and due to the ejection button. The sleeve of the end cap ensures that the device provides a clean appearance with no exposed openings for receiving the fingers of the user. The end cap cooperates with the end portion of the housing as a sliding fit. There is no necessity for any lock at either end of the movement of the end cap in view of the friction action of the friction head on the plunger. The magnet within the holder ensures that the bits are held in place even which the holders are removed and transported from place to place. The indexing action of the holder ensures that the user feels when the bits are properly aligned with the plunger for return of a plunger from its retracted position to the extended forward present position.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A screwdriver comprising:

a housing having a first axis therealong and an outer manual grasping surface which generally coaxially surrounds the axis and which provides a surface which can be grasped by a user for rotating the housing about the first axis;

an elongate tube attached to the housing for rotation therewith having a hollow interior and extending through the housing along the first axis to a forward presentation end of the tube;

the housing having a generally cylindrical receptacle defining a second axis adjacent to and parallel to the first axis;

a rotatable storage holder mounted in the generally cylindrical recepticle of the housing and containing a plurality of tool bits and arranged to rotate about the second axis;

the rotatable holder including a plurality of receptacles each containing a respective one of the tool bits, the receptacles being arranged parallel to the second axis and in angularly spaced relation around the second axis;

the rotatable holder and the first and second axes being arranged such that rotation of the holder causes each receptacle in turn to move from an operating position aligned with the first axis to a storage position spaced from the first axis;

an end cap slidable longitudinally relative to the housing for movement from a retracted position to a forward position;

a plunger carried on the end cap and mounted within the tube for forward and rearward movement therein from the retracted position, in which a forward end of the plunger is retracted rearwardly of the holder, to the forward position adjacent the forward presentation end;

the plunger having a magnetic bit carrying head at the forward end for carrying a bit from that receptacle of the holder which is in the operating position from the receptacle forwardly along the tube to the presentation end;

the holder being rotatable in the housing when the plunger is moved to the retracted position to move the receptacles to carry the bits from the operating position to the storage positions;

the elongate tube having an interior surface which is polygonal in cross-section and matches an outer surface of each of bits such that rotation of the housing causes rotation of the elongate tube and driving rotation of the bit;

the holder being mounted in the generally cylindrical receptacle of the housing so that it is held in position in the generally cylindrical receptacle of the housing while the holder rotates about the second axis;

the housing having an opening in the generally cylindrical receptacle of the housing to one side of the second axis such that the holder is readily removable from and replaceable in the generally cylindrical receptacle of the housing by movement of the holder through the opening in a direction at right angles to the second axis and therefore at right angles to the receptacles in the holder;

and an ejection member mounted on the housing and manually operable for applying an ejection force to the holder for rejecting the holder from the housing for replacement.

2. The screwdriver according to claim 1 wherein the ejection member comprises a button manually depressible on the housing at a position thereon opposite to the holder.

3. The screwdriver according to claim 1 wherein there is provided an indexing arrangement providing detents at specific angularly spaced locations of the rotation of the holder so that each detent corresponds to the angular location of a respective one of the receptacles so as to align that receptacle on the first axis; wherein the holder includes a first portion defining the receptacles and a second portion rotatable relative to the first portion about the second axis; wherein the second portion has an abutment thereon for engaging the housing and preventing rotation of the second portion relative to the housing; and wherein the indexing arrangement comprises at least one projection on one of the first and second portions and a plurality of recesses on the other of the first and second portions.

4. A screwdriver comprising:

a housing having a first axis therealong and an outer manual grasping surface which generally coaxially surrounds the axis and which provides a surface which can be grasped by a user for rotating the housing about the first axis;

an elongate tube attached to the housing for rotation therewith having a hollow interior and extending through the housing along the first axis to a forward presentation end of the tube;

the housing having a generally cylindrical receptacle defining a second axis adjacent to and parallel to the first axis;

a rotatable storage holder mounted in the generally cylindrical receptacle of the housing and containing a plurality of tool bits and arranged to rotate about the second axis;

the rotatable holder including a plurality of receptacles each containing a respective one of the tool bits, the receptacles being arranged parallel to the second axis and in angularly spaced relation around the second axis;

the rotatable holder and the first and second axes being arranged such that rotation of the holder causes each receptacle in turn to move from an operating position aligned with the first axis to a storage position spaced from the first axis;

an end cap slidable longitudinally relative to the housing for movement from a retracted position to a forward position;

a plunger carried on the end cap and mounted within the tube for forward and rearward movement therein from the retracted position, in which a forward end of the plunger is retracted rearwardly of the holder, to the forward position adjacent the forward presentation end;

the plunger having a magnetic bit carrying head at the forward end for carrying a bit from that receptacle of the holder which is in the operating position from the receptacle forwardly along the tube to the presentation end;

the holder being rotatable in the housing when the plunger is moved to the retracted position to move the receptacles to carry the bits from the operating position to the storage positions;

the elongate tube having an interior surface which is polygonal in cross-section and matches an outer surface of each of bits such that rotation of the housing causes rotation of the elongate tube and driving rotation of the bit;

the holder being mounted in the generally cylindrical receptacle of the housing so that it is held in position in the generally cylindrical receptacle of the housing while the holder rotates about the second axis;

the housing having an opening in the generally cylindrical receptacle of the housing to one side of the second axis such that the holder is readily removable from and replaceable in the generally cylindrical receptacle of the housing by movement of the holder through the opening in a direction at right angles to the second axis and therefore at right angles to the receptacles in the holder.

5. The screwdriver according to claim 4 wherein the head of the plunger includes a flat front face for contacting a flat rear face of the bit such that rotation of the holder sweeps the bit off the flat face of the head.

6. The screwdriver according to claim 4 wherein the housing defines a portion extending axially from the generally cylindrical receptacle to an end of the portion opposite to the elongate tube with the portion arranged so as to surround the plunger; wherein the housing defines a shoulder surrounding the portion at an end of the portion adjacent the generally cylindrical receptacle; and wherein the end cap carries a sleeve which surrounds the portion of the housing with the portion of the housing extending into the sleeve such that the plunger is enclosed in the extended position of the end cap by the portion and such that an end of the sleeve butts against the shoulder in the retracted position of the end cap.

7. The screwdriver according to claim 6 wherein the sleeve and the portion are polygonal and co-operate to transfer torque therebetween.

8. The screwdriver according to claim 4 wherein the holder includes a magnet mounted in the holder so as to apply a magnetic force tending to hold the bits in place in the receptacles when the holder is removed from the housing.

9. The screwdriver according to claim 8 wherein the magnet is mounted in an axial central bore of the holder.

10. A screwdriver comprising:

a housing having a first axis therealong and an outer manual grasping surface which generally coaxially surrounds the axis and which provides a surface which can be grasped by a user for rotating the housing about the axis;

an elongate tube attached to the housing for rotation therewith having a hollow interior and extending through the housing along the first axis to a forward presentation end of the tube;

the housing having a generally cylindrical receptacle defining a second axis adjacent to and parallel to the first axis;

a rotatable storage holder mounted in the housing containing a plurality of tool bits and arranged to rotate about the second axis;

the rotatable holder including a plurality of receptacles each containing a respective one of the tool bits, the receptacles being arranged parallel to the second axis and in angularly spaced relation around the second axis;

the rotatable holder and the first and second axes being arranged such that rotation of the holder causes each receptacle in turn to move from an operating position aligned with the first axis to a storage position spaced from the first axis;

an end cap slidable longitudinally relative to the housing for movement from a retracted position to a forward position;

a plunger carried on the end cap and mounted within the tube for forward and rearward movement therein from the retracted position, in which a forward end of the plunger is retracted rearwardly of the holder, to the forward position adjacent the forward presentation end;

the plunger having a magnetic bit carrying head at the forward end for carrying a bit from that receptacle of the holder which is in the operating position from the receptacle forwardly along the tube to the presentation end;

the holder being rotatable in the housing when the plunger is moved to the retracted position to move the receptacles to carry the bits from the operating position to the storage positions;

the elongate tube having an interior surface which is polygonal in cross-section and matches an outer surface of each of bits such that rotation of the housing causes rotation of the elongate tube and driving rotation of the bit;

the holder being mounted in the housing so that it is readily removable from and replaceable in the housing;

wherein the housing defines a portion extending axially from the generally cylindrical receptacle to an end of the portion opposite to the elongate tube with the portion arranged so as to surround the plunger;

wherein the housing defines a shoulder surrounding the portion at an end of the portion adjacent the generally cylindrical receptacle; and wherein the end cap carries a sleeve which surrounds the portion of the housing with the portion of the housing extending into the sleeve such that the plunger is enclosed in the extended position of the end cap by the portion and such that an end of the sleeve butts against the shoulder in the retracted position of the end cap.

11. The screwdriver according to claim 10 wherein the sleeve and the portion are polygonal and co-operate to transfer torque therebetween.

12. A screwdriver comprising:

a housing having a first axis therealong and an outer manual grasping surface which generally coaxially surrounds the axis and which provides a surface which can be grasped by a user for rotating the housing about the axis;

an elongate tube attached to the housing for rotation therewith having a hollow interior and extending through the housing along the first axis to a forward presentation end of the tube;

the housing having a generally cylindrical receptacle defining a second axis adjacent to and parallel to the first axis;

a rotatable storage holder mounted in the housing containing a plurality of tool bits and arranged to rotate about the second axis;

the rotatable holder including a plurality of receptacles each containing a respective one of the tool bits, the receptacles being arranged parallel to the second axis and in angularly spaced relation around the second axis;

the rotatable holder and the first and second axes being arranged such that rotation of the holder causes each receptacle in turn to move from an operating position aligned with the first axis to a storage position spaced from the first axis;

an end cap slidable longitudinally relative to the housing for movement from a retracted position to a forward position;

a plunger carried on the end cap and mounted within the tube for forward and rearward movement therein from the retracted position, in which a forward end of the plunger is retracted rearwardly of the holder, to the forward position adjacent the forward presentation end;

the plunger having a magnetic bit carrying head at the forward end for carrying a bit from that receptacle of the holder which is in the operating position from the receptacle forwardly along the tube to the presentation end;

the holder being rotatable in the housing when the plunger is moved to the retracted position to move the receptacles to carry the bits from the operating position to the storage positions;

the elongate tube having an interior surface which is polygonal in cross-section and matches an outer surface of each of bits such that rotation of the housing causes rotation of the elongate tube and driving rotation of the bit;

the holder being mounted in the housing so that it is readily removable from and replaceable in the housing;

wherein the holder includes a magnet mounted in the holder so as to apply a magnetic force tending to hold the bits in place in the receptacles when the holder is removed from the housing.

13. The screwdriver according to claim 12 wherein the magnet is mounted in an axial central bore of the holder.

14. A screwdriver comprising:

a housing having a first axis therealong and an outer manual grasping surface which generally coaxially surrounds the axis and which provides a surface which can be grasped by a user for rotating the housing about the axis;

an elongate tube attached to the housing for rotation therewith having a hollow interior and extending through the housing along the first axis to a forward presentation end of the tube;

the housing having a generally cylindrical receptacle defining a second axis adjacent to and parallel to the first axis;

a rotatable storage holder mounted in the housing containing a plurality of tool bits and arranged to rotate about the second axis;

the rotatable holder including a plurality of receptacles each containing a respective one of the tool bits, the receptacles being arranged parallel to the second axis and in angularly spaced relation around the second axis;

the rotatable holder and the first and second axes being arranged such that rotation of the holder causes each receptacle in turn to move from an operating position aligned with the first axis to a storage position spaced from the first axis;

an end cap slidable longitudinally relative to the housing for movement from a retracted position to a forward position;

a plunger carried on the end cap and mounted within the tube for forward and rearward movement therein from the retracted position, in which a forward end of the plunger is retracted rearwardly of the holder, to the forward position adjacent the forward presentation end;

the plunger having a magnetic bit carrying head at the forward end for carrying a bit from that receptacle of the holder which is in the operating position from the receptacle forwardly along the tube to the presentation end;

the holder being rotatable in the housing when the plunger is moved to the retracted position to move the receptacles to carry the bits from the operating position to the storage positions;

the elongate tube having an interior surface which is polygonal in cross-section and matches an outer surface of each of bits such that rotation of the housing causes rotation of the elongate tube and driving rotation of the bit;

the holder being mounted in the housing so that it is readily removable from and replaceable in the housing;

wherein the holder includes a first portion defining the receptacles and a second portion rotatable relative to the first portion about the second axis;

the second portion having an abutment thereon for engaging the housing and preventing rotation of the second portion relative to the housing;

and an indexing arrangement providing detents at specific angularly spaced locations of the rotation of the holder so that each detent corresponds to the angular location of a respective one of the receptacles so as to align that receptacle on the first axis;

the indexing arrangement comprising at least one projection on one of the first and second portions and a plurality of recesses on the other of the first and second portions.

15. A screwdriver comprising:

a housing having a first axis therealong and an outer manual grasping surface which generally coaxially surrounds the axis and which provides a surface which can be grasped by a user for rotating the housing about the first axis;

an elongate tube attached to the housing for rotation therewith having a hollow interior and extending through the housing along the first axis to a forward presentation end of the tube;

the housing having a generally cylindrical receptacle defining a second axis adjacent to and parallel to the first axis;

a rotatable storage holder mounted in the generally cylindrical receptacle of the housing and containing a plurality of tool bits and arranged to rotate about the second axis;

the rotatable holder including a plurality of receptacles each containing a respective one of the tool bits, the receptacles being arranged parallel to the second axis and in angularly spaced relation around the second axis;

the rotatable holder and the first and second axes being arranged such that rotation of the holder causes each receptacle in turn to move from an operating position aligned with the first axis to a storage position spaced from the first axis;

an end cap slidable longitudinally relative to the housing for movement from a retracted position to a forward position;

a plunger carried on the end cap and mounted within the tube for forward and rearward movement therein from the retracted position, in which a forward end of the plunger is retracted rearwardly of the holder, to the forward position adjacent the forward presentation end;

the plunger having a magnetic bit carrying head at the forward end for carrying a bit from that receptacle of the holder which is in the operating position from the receptacle forwardly along the tube to the presentation end;

the holder being rotatable in the housing when the plunger is moved to the retracted position to move the receptacles to carry the bits from the operating position to the storage positions;

the elongate tube having an interior surface which is polygonal in cross-section and matches an outer surface of each of bits such that rotation of the housing causes rotation of the elongate tube and driving rotation of the bit;

the holder being mounted in the generally cylindrical receptacle of the housing so that it is held in position in the generally cylindrical receptacle of the housing while the holder rotates about the second axis;

the housing having an opening in the generally cylindrical receptacle of the housing to one side of the second axis such that the holder is readily removable from and replaceable in the generally cylindrical receptacle of the housing by movement of the holder through the opening in a direction at right angles to the second axis and therefore at right angles to the receptacles in the holder;

and an indexing arrangement providing detents at specific angularly spaced locations of the rotation of the holder so that each detent corresponds to the angular location of a respective one of the receptacles so as to align that receptacle on the first axis.

* * * * *